US005760814A

United States Patent [19]

Kang

[11] Patent Number: 5,760,814

[45] Date of Patent: Jun. 2, 1998

[54] DEVICE FOR UNCURLING THERMAL SENSITIVE RECORDING PAPER

[75] Inventor: Sung-Wook Kang, Kyungki-do, Rep. of Korea

[73] Assignee: SamSung Electronics Co., Ltd., Suwon, Rep. of Korea

[21] Appl. No.: 678,053

[22] Filed: Jul. 12, 1996

[30] Foreign Application Priority Data

Jul. 13, 1995 [KR] Rep. of Korea ..... 1995-17247

[51] Int. Cl.[6] ..... B41J 2/32; B41J 15/00

[52] U.S. Cl. ..... 347/218; 347/222; 400/613; 400/663; 400/693

[58] Field of Search ..... 347/218, 222; 400/613, 663, 693

[56] References Cited

U.S. PATENT DOCUMENTS

| | | | |
|---|---|---|---|
| 5,201,588 | 4/1993 | Sakai et al. | 347/222 |
| 5,202,737 | 4/1993 | Hollar . | |
| 5,237,381 | 8/1993 | Hamada . | |
| 5,287,157 | 2/1994 | Miyazato et al. . | |
| 5,414,503 | 5/1995 | Siegel et al. . | |
| 5,450,102 | 9/1995 | Ishida et al. . | |
| 5,483,264 | 1/1996 | Jeong . | |
| 5,515,152 | 5/1996 | Kuo . | |
| 5,519,481 | 5/1996 | Kuo . | |

*Primary Examiner*—Huan H. Tran
*Attorney, Agent, or Firm*—Robert E. Bushnell, Esq

[57] ABSTRACT

A device for uncurling thermal sensitive recording paper includes a paper container having first and second arcuate portions that are rotatably connected to form a cylindrical body. The paper container accommodates installation of a roll of the thermal sensitive recording paper. A projection is formed on a first end of the first arcuate portion for engaging and applying a predetermined pressure upon the thermal sensitive recording paper. A groove is formed between the projection and a first end of the second arcuate portion to provide a path through which the thermal sensitive recording paper travels. A locking member is positioned at the first end of the first arcuate portion and provides a slot to accommodate the connection between the first and second arcuate portions. A pole extends outwardly from the first end of the second arcuate portion and is inserted into the slot to establish the connection between the first and second arcuate portions. A hinge rotatably connects second ends of the first and second arcuate portions, respectively. The second ends are positioned respectively opposite the first ends. A thermal printing head is positioned adjacent to the paper container for generating an image on the thermal sensitive recording paper as the thermal sensitive recording paper is withdrawn from the paper container. A platen roller is formed on a first side of the thermal printing head for withdrawing the thermal sensitive recording paper from the paper container.

16 Claims, 3 Drawing Sheets

DEVICE FOR UNCURLING THERMAL SENSITIVE RECORDING PAPER

CROSS-REFERENCE TO RELATED APPLICATIONS

This application makes reference to, incorporates the same herein, and claims all benefits accruing under 35 U.S.C. §119 arising from an application for *Device For Uncurling Thermal Sensitive Recording Paper* earlier filed in the Korean Industrial Property Office on 13 Jul. 1995 and there duly assigned patent application Ser. No. 17247/1995.

BACKGROUND OF THE INVENTION

The present invention generally relates to a printing system using thermal sensitive recording paper, and more particularly, to a device for uncurling thermal sensitive recording paper in a printing system.

In line with the rapid strides in the field of communication, devices such as facsimiles are widely used in business firms, manufacturing companies, and homes. The facsimile is provided with a printing system that prints received messages, and utilizes recording paper to print the received messages. Thermal sensitive recording paper is a chemically treated recording medium on which such messages can be directly printed. Since thermal sensitive recording paper typically comes in a roll, its use has eliminated much of the inconvenience caused by the need to frequently replenish single sheets of paper. One problem, however, that arises from the use of thermal sensitive recording paper in the roll form is paper curling. That is, when thermal sensitive recording paper passes through the printing system after a printing operation, the paper is often curled up.

One prior art reference that addresses this problem is U.S. Pat. No. 5,483,264 entitled *Apparatus For Flattening Thermosensitive Recording Paper Of A Facsimile Machine* issued to Jeong. In Jeong '264, a thermosensitive recording paper flattening apparatus is interlocked with a lever and is adapted to exert a flattening force in the opposite direction of the initial wind on thermosensitive recording paper when the lever rotates in a first direction. The flattening force is released when the lever rotates in a second direction opposite to the first direction. While this type of conventional art possesses merit in its own right, I note that it requires a rather complicated manufacturing process.

SUMMARY OF THE INVENTION

Therefore, it is an object of the present invention to provide an improved device for uncurling thermal sensitive recording paper in a printing system.

It is another object to provide a device for uncurling thermal sensitive recording paper that can be manufactured with increased productivity and cost effectiveness.

It is still another object to provide a device for uncurling thermal sensitive recording paper that can effectively expel the paper from a printing system in an uncurled condition.

It is yet another object to provide a device for uncurling thermal sensitive recording paper that prevents paper jams in a printing system.

It is still yet another object to provide a device for uncurling thermal sensitive recording paper that can be constructed in a reduced size.

It is a further object to provide a device that can uncurl printed sheets of thermal sensitive recording paper regardless of the amount of paper remaining on a paper roll.

To achieve these and other objects, the present invention provides a device for uncurling thermal sensitive recording paper. The device includes a paper container having first and second arcuate portions that are rotatably connected to form a cylindrical body. The paper container accommodates installation of a roll of the thermal sensitive recording paper. A projection is formed on a first end of the first arcuate portion for engaging and applying a predetermined pressure upon the thermal sensitive recording paper. A groove is formed between the projection and a first end of the second arcuate portion to provide a path through which the thermal sensitive recording paper travels. A locking member is positioned at the first end of the first arcuate portion and provides a slot to accommodate the connection between the first and second arcuate portions. A pole extends outwardly from the first end of the second arcuate portion and is inserted into the slot to establish the connection between the first and second arcuate portions. A hinge rotatably connects second ends of the first and second arcuate portions, respectively. The second ends are positioned respectively opposite the first ends. A thermal printing head is positioned adjacent to the paper container for generating an image on the thermal sensitive recording paper as the thermal sensitive recording paper is withdrawn from the paper container. A platen roller is formed on a first side of the thermal printing head for withdrawing the thermal sensitive recording paper from the paper container.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Figure 1A:
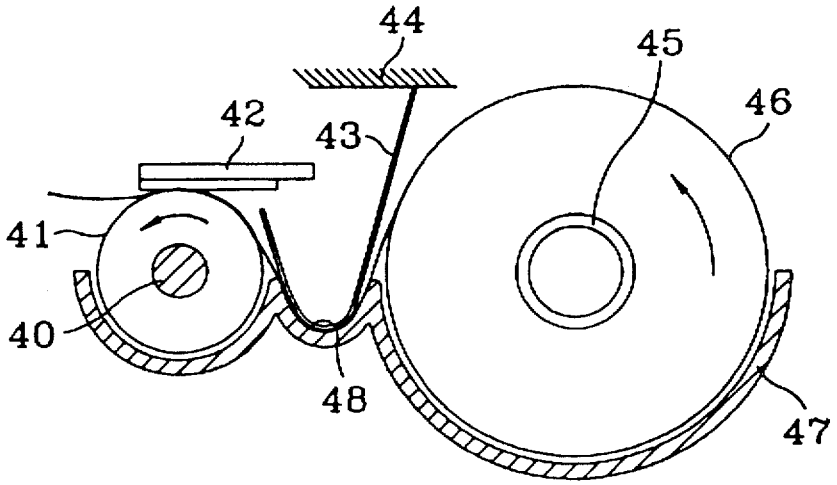
FIGS. 1A and 1B are schematic views of a general thermal sensitive recording paper uncurling device used in a printing system.
Figure 1B:
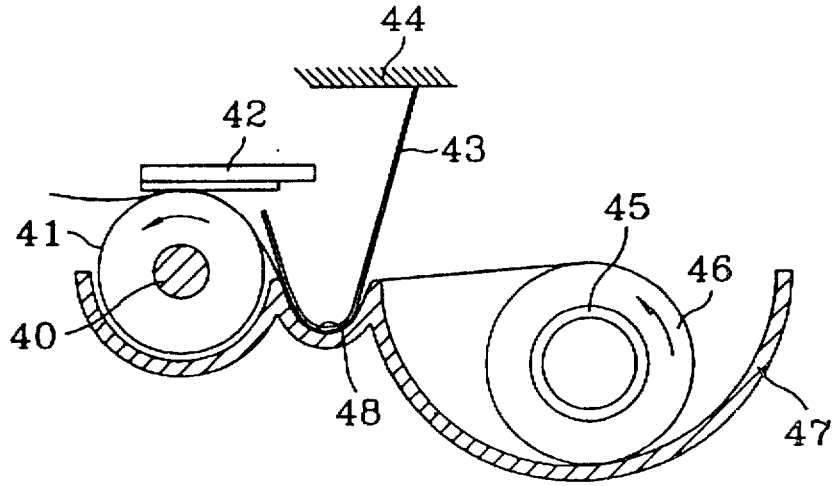

Turning now to the drawings and referring to FIGS. 1A and 1B, schematic views of a general thermal sensitive recording paper uncurling device for uncurling thermal sensitive recording paper during a printing operation are shown. FIG. 1A illustrates the condition where a given volume of thermal sensitive recording paper is wound around the roll, and FIG. 1B illustrates the condition where only a small quantity of thermal sensitive recording paper is wound around the roll.

The device shown in FIGS. 1A and 1B includes a blank paper container 47 that holds a roll 45 of thermal sensitive recording paper 46. A guide member 43 engages and guides the paper 46, and a platen roller 41 is driven by a roller spindle 40. The device further includes a thermal printing head (TPH) 42, and a guide bracket 44 that supports guide member 43. A guide groove 48 is formed in blank paper container 47 for guiding the thermal sensitive printing paper 46 during a printing operation.

A description of the device shown in FIGS. 1A and 1B during the printing operation will now be provided.

As platen roller 41 rotates in the direction indicated by its corresponding arrow, the roll 45 of thermal sensitive recording paper 46 rotates in the direction indicated by its corresponding arrow, and the paper 46 is unwound from the roll 45. A lower portion of guide member 43 that extends into guide groove 48 engages and smooths the paper 46 during its passage. In particular, as the thermal sensitive recording paper 46 passes guide member 43, the paper 46 is forced into a curled position that is opposite to the direction in which the paper 46 was originally wound around roll 45. Accordingly, the thermal sensitive recording paper 46 passes between platen roller 41 and thermal print head (TPH) 42 in an uncurled condition. The thermal sensitive printing paper 46 goes through a predetermined printing operation, and is then discharged from the printing system by the rotation of platen roller 41.

During assembly of the configuration shown in FIGS. 1A and 1B, a great amount of precision is required in forming guide groove 48 within blank paper container 47. In particular, if guide groove 48 is too large, then the paper 46 may not be sufficiently uncurled as it is output from the printing system. On the other hand, if guide groove 48 is too small, then the paper 46 may not have enough space for passage, and paper jams are likely to occur. Due to the amount of precision required in assembling this configuration, it can not be manufactured with optimal productivity. Moreover, in situations when only a small quantity of paper 46 remains wound around the roll 45, the paper 46 is often difficult to uncurl.

Figure 2:
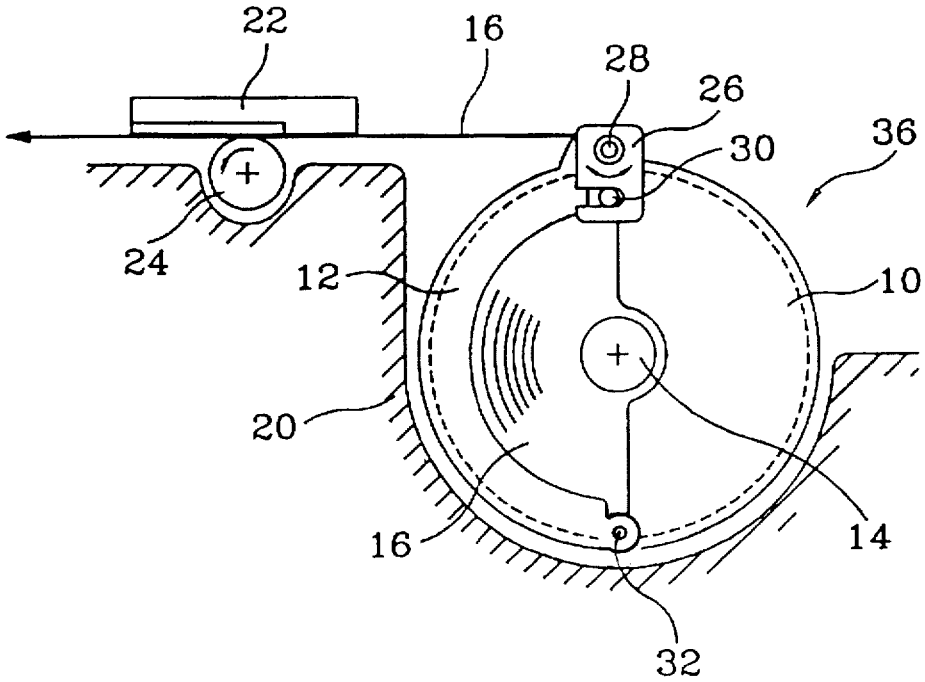
FIG. 2 is a schematic view of a thermal sensitive recording paper uncurling device constructed according to the principles of the present invention.
Figure 3:
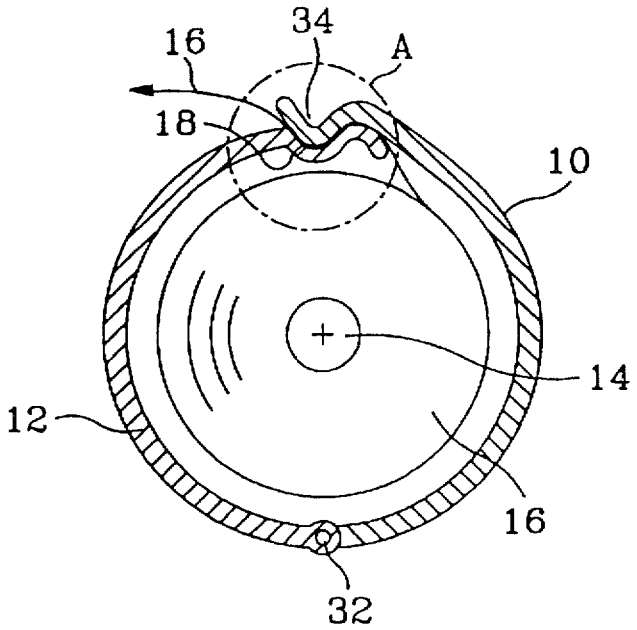
FIG. 3 is a sectional view of the thermal sensitive recording paper uncurling device shown in FIG. 2.
Figure 4:
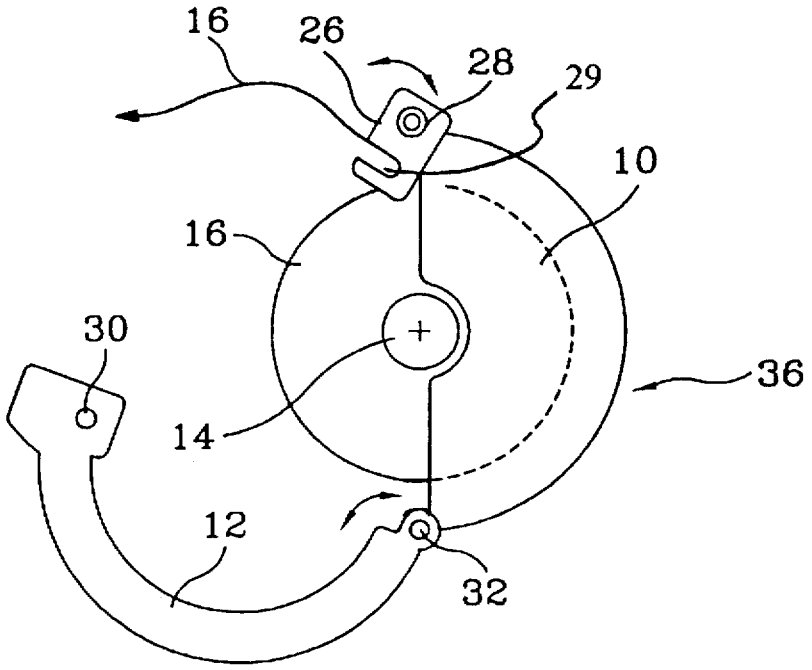
FIG. 4 is another schematic view of the thermal sensitive recording paper uncurling device constructed according to the principles of the present invention.

Referring now to FIGS. 2 through 4, a thermal sensitive recording paper uncurling device constructed according to the principles of the present invention is shown. The thermal sensitive recording paper uncurling device of FIGS. 2 through 4 includes a blank paper container 36 having a cylindrical body made up of a right arcuate portion 10 and a left arcuate portion 12. The right and left arcuate portions 10 and 12 are each semi-circular in shape. Blank paper container 36 is used to retain a roll 14 of thermal sensitive recording paper 16.

The right arcuate portion 10 has a projection 34 on an upper end to engage and apply a predetermined pressure upon the paper 16 during its passage. The projection 34 exhibits a "V" shape and has a rounded end that contacts the paper 16 and prevents it from being scratched. The left arcuate portion 12 has an outwardly extending pole 30 that fits within a slot 29 formed within a locking member 26 that connects right and left arcuate portions 10 and 12 in a locked arrangement. An upper end of the left arcuate portion 12 is positioned adjacent to the projection 34 of right arcuate portion 10 to form a groove 18 through which the paper 16 passes and is uncurled. The groove 18 exhibits a "V" shape, and is rounded to prevent the paper 16 from being scratched.

The upper end of right arcuate portion 10 is connected to locking member 26 via a hinge 28. Lower ends of the right and left arcuate portions 10 and 12 are connected via another hinge 32 so that the arcuate portions 10 and 12 are rotatable with respect to one another. A thermal printing head (TPH) 22 is adjacent to blank paper container 36 for reproducing received images on the thermal sensitive recording paper 16, and a platen roller 24 is mounted within a frame 20 beneath thermal printing head (TPH) 22 for pulling the paper 16 in one direction and maintaining its tautness.

Operation of the thermal sensitive recording paper uncurling device constructed according to the principles of the present invention will now be described.

Referring to FIG. 4, the roll 14 of thermal sensitive recording paper 16 is first installed within the right arcuate portion 10. The left arcuate portion 12 is then rotated upwardly so that the pole 30 inserts within the slot 29 formed in locking member 26. As a result, the roll 14 of thermal sensitive recording paper 16 is mounted within the blank paper container 36.

As the paper 16 is extracted from the blank paper container 36 and passes over the upper portion of platen roller 24, images are printed on the paper 16 by the thermal printing head (TPH) 22. The paper 16 is then led to an upper or lower guide path (not shown) by the rotation of the platen roller 24, and is cut to an appropriate length by a paper cutter (not shown) for output through an outlet of the printing system.

Figure 5:
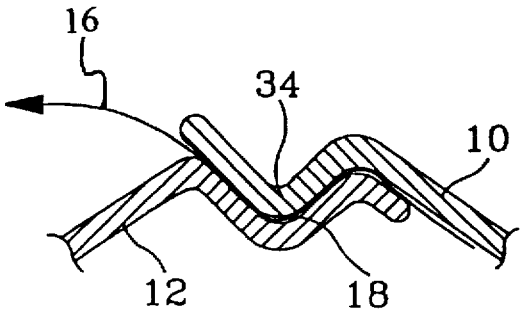
FIG. 5 is an enlarged view of the portion 'A' shown in FIG. 3.

In order to uncurl the thermal sensitive recording paper 16 as it is extracted from the blank paper container 36, the paper 16 is passed through the groove 18 positioned between the projection 34 of right arcuate portion 10 and the upper end of the left arcuate portion 12, as shown in FIGS. 3 and 5. Passage of the paper 16 through groove 18 forces the paper 16 into a curled position that is opposite to the direction in which the paper 16 was originally wound around roll 14. Accordingly, the thermal sensitive recording paper 16 passes between platen roller 24 and thermal print head (TPH) 22 in an uncurled condition.

As described above, the thermal sensitive recording paper uncurling device of the present invention can prevent the thermal sensitive recording paper 16 from being curled up by utilizing the pressure that is provided when the right arcuate portion 10 and left arcuate portion 12 are joined together. Accordingly, the paper 16 is in an uncurled condition during the printing operation, and paper jams are prevented.

Moreover, since sheets of paper 16 are discharged from the printing system in an uncurled condition, the sheets of paper 16 can be properly deposited into an output tray of the printing system in the order in which they were printed. According to the present invention, the space between the platen roller 24 and the blank paper container 36 is reduced as compared to a conventional configuration, and the printing system can therefore be made smaller. Moreover, the thermal sensitive recording paper uncurling device of the present invention has advantages in that it can be easily assembled with a reduced number of components. Accordingly, it can be manufactured with increased productivity, and for a reduced cost.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A device for uncurling thermal sensitive recording paper, comprising:

a paper container comprised of first and second arcuate portions rotatably connected to form a cylindrical body, said paper container accommodating installation of a roll of said thermal sensitive recording paper;

projection formed on a first end of said first arcuate portion for engaging and applying a predetermined pressure upon said thermal sensitive recording paper, said projection and a first end of said second arcuate portion having a groove formed therebetween to provide a path through which said thermal sensitive recording paper travels;

a locking member positioned at said first end of said first arcuate portion and having a slot to accommodate the connection between said first and second arcuate portions;

a pole extending outwardly from said first end of said second arcuate portion for insertion into said slot to establish the connection between said first and second arcuate portions;

a first hinge for rotatably connecting second ends of said first and second arcuate portions, respectively, said second ends being positioned respectively opposite said first ends;

a thermal printing head positioned adjacent to said paper container for generating an image on said thermal sensitive recording paper as said thermal sensitive recording paper is withdrawn from said paper container; and a platen roller formed on a first side of said thermal printing head for withdrawing said thermal sensitive recording paper from said paper container.

2. The device as claimed in claim 1, wherein said projection exhibits a "V" shape.

3. The device as claimed in claim 1, wherein said projection comprises a rounded portion for preventing scratching of said thermal sensitive recording paper.

4. The device as claimed in claim 1, wherein said groove formed between said projection and said first end of said second arcuate portion exhibits a "V" shape.

5. The device as claimed in claim 1, wherein said groove comprises a rounded inner surface for preventing scratching of said thermal sensitive recording paper.

6. The device as claimed in claim 1, further comprising a second hinge for rotatably connecting said locking member to said first end of said first arcuate portion.

7. The device as claimed in claim 1, wherein said first and second arcuate portions each exhibit a semi-circular shape.

8. A device for uncurling thermal sensitive recording paper, comprising:

containing means comprised of first and second portions rotatably connected to form a cylindrical body, said containing means accommodating installation of a roll of said thermal sensitive recording paper;

a projection formed on a first end of said first arcuate portion for engaging and applying a predetermined pressure upon said thermal sensitive recording paper, said projection and a first end of said second arcuate portion having a groove formed therebetween to provide a path through which said thermal sensitive recording paper travels;

locking means positioned at said first end of said first arcuate portion and having a slot to accommodate the connection between said first and second arcuate portions;

a pole extending outwardly from said first end of said second arcuate portion for insertion into said slot to establish the connection between said first and second arcuate portions; and first connecting means for rotatably connecting second ends of said first and second arcuate portions, respectively, said second ends being positioned respectively opposite said first ends.

9. The device as claimed in claim 8, further comprising:

image generating means positioned adjacent to said containing means for generating an image on said thermal sensitive recording paper as said thermal sensitive recording paper is expelled from said containing means; and withdrawal means formed on a first side of said image generating means for withdrawing said thermal sensitive recording paper from said containing means.

10. The device as claimed in claim 8, wherein said projection comprises a rounded portion for preventing scratching of said thermal sensitive recording paper.

11. The device as claimed in claim 10, wherein said groove comprises a rounded inner surface for preventing scratching of said thermal sensitive recording paper.

12. The device as claimed in claim 8, further comprising second connecting means for rotatably connecting said locking means to said first end of said first arcuate portion.

13. The device as claimed in claim 12, wherein said first and second arcuate portions each exhibit a semi-circular shape.

14. A device for uncurling thermal sensitive recording paper, comprising:

a paper container comprised of first and second semi-circular portions rotatably connected to form a cylindrical body, said paper container accommodating installation of a roll of said thermal sensitive recording paper;

a projection formed on a first end of said first semi-circular portion for engaging and applying a predetermined pressure upon said thermal sensitive recording paper, said projection and a first end of said second semi-circular portion having a groove formed therebetween to provide a path through which said thermal sensitive recording paper travels;

a locking member positioned at said first end of said first semi-circular portion and having a slot to accommodate the connection between said first and second semi-circular portions;

a pole extending outwardly from said first end of said second semi-circular portion for insertion into said slot to establish the connection between said first and second semi-circular portions; and a hinge for rotatably connecting second ends of said first and second semi-circular portions, respectively, said second ends being positioned respectively opposite said first ends.

15. The device as claimed in claim 14, wherein said projection comprises a rounded portion for preventing scratching of said thermal sensitive recording paper.

16. The device as claimed in claim 14, wherein said groove comprises a rounded inner surface for preventing scratching of said thermal sensitive recording paper.

* * * * *